US007498743B2

(12) United States Patent
Anandan

(10) Patent No.: US 7,498,743 B2
(45) Date of Patent: Mar. 3, 2009

(54) LARGE AREA PLASMA DISPLAY WITH INCREASED DISCHARGE PATH

(75) Inventor: Munisamy Anandan, 13009 Thome Valley Dr., Del Valle, TX (US) 78617

(73) Assignee: Munisamy Anandan, Austin, TX (US)

( * ) Notice: Subject to any disclaimer, the term of this patent is extended or adjusted under 35 U.S.C. 154(b) by 752 days.

(21) Appl. No.: 11/011,636

(22) Filed: Dec. 14, 2004

(65) Prior Publication Data

US 2006/0125394 A1 Jun. 15, 2006

(51) Int. Cl.
*H01J 17/49* (2006.01)

(52) U.S. Cl. ..... 313/582; 313/491

(58) Field of Classification Search ..... 313/582–587, 313/491–494

See application file for complete search history.

(56) References Cited

U.S. PATENT DOCUMENTS 3,684,909 A * 8/1972 Caras ..... 313/54
5,182,489 A * 1/1993 Sano ..... 313/485
5,410,219 A * 4/1995 Takei et al. ..... 315/169.4
5,948,537 A * 9/1999 Onoda et al. ..... 428/426
6,100,633 A * 8/2000 Okumura et al. ..... 313/486
6,156,141 A * 12/2000 Shirakawa ..... 156/67
6,407,509 B1 * 6/2002 Ikeda et al. ..... 315/169.4
6,583,770 B1 * 6/2003 Antila et al. ..... 345/1.1
6,614,412 B1 * 9/2003 Hirano et al. ..... 345/60
6,621,234 B2 * 9/2003 Itoh et al. ..... 315/169.4
6,638,129 B2 * 10/2003 Sano et al. ..... 445/24
2001/0024921 A1 * 9/2001 Hirano ..... 445/24
2002/0089284 A1 * 7/2002 Hayashi ..... 313/582

* cited by examiner

*Primary Examiner*—Toan Ton
*Assistant Examiner*—Hana A Sanei

(57) ABSTRACT

A very large area plasma display for indoor and outdoor application ranging in size to several feet in diagonal, incorporating plurality of 'tiles' of plasma pixels comprising plasma sustain electrodes and dielectric barrier on one substrate and address electrode on other substrate, the substrates being kept in alignment to oppose each other and orient plasma sustain electrodes, with dielectric barrier, orthogonal to address electrodes. The presence of the dielectric barrier enhances the path length of Hg-inert gas plasma resulting in increased UV generation and hence increased visible light that enhances the luminous efficiency of the large area plasma display. Plurality of plasma pixels are fabricated in a single panel called 'tile' and hermetically sealed. The 'tiles' are assembled to generate a large area plasma display thus eliminating the need for expensive process equipments and tedious procedures to handle large area substrates.

6 Claims, 27 Drawing Sheets

LARGE AREA PLASMA DISPLAY WITH INCREASED DISCHARGE PATH

CROSS REFERENCE TO RELATED APPLICATION

U.S. Pat. No. 6,452,326B1—Xiaoqin Ge et.al, Sep. 17, 2002
U.S. Pat. No. 6,396,983—Lowry et.al, May 28, 2002
U.S. Pat. No. 5,095,244—Maeda et.al, Mar. 10, 1992
U.S. Pat. No. 4,833,542—Hara et.al, May 23, 1989
United States Patent Appln. No. 20040130252—Xiaoqin Ge et.al, Jul. 8, 2004
U.S. Pat. No. 4,529,909—Kamega Ya et.al, Jul. 16, 1985
U.S. Provisional Patent Application No. 60/513,430, Oct. 22, 2003

OTHER PUBLICATIONS

1. Tsutae Shinoda, Manabu Ishimoto, Hitoshi Yamada, Akira Tokai and Kenji Awamoto—"New approach for wall display with fine plasma tube array technology"—SID 02 Digest of Technical papers, pp. 1072-1075, SID 2002 International Symposium vol. XXXIII, No. 2, May 2002.
2. H. Hirakawas, K. Shinohae, A. Tokai, H. Yamada, Y. Yamazaki, M. Ishimoto, K. Awamoto, T. Shinoda—"Dynamic driving characteristics of plasma tube array"—SID 04 Digest of Technical papers, pp. 810-813, SID 2004 International Symposium vol. XXXV, Book II, May 2004.
3. Large area color display "Skypix"—Yoshiyasu Sakagauchi et.al, SID' 92 Digest of Technical papers, SID International Symposium, May 1991.

STATEMENT REGARDING FEDERALLY SPONSORED RESEARCH OR DEVELOPMENT

Not Applicable

REFERENCE TO SEQUENCE LISTING, A TABLE, OR A COMPUTER PROGRAM LISTING COMPACT DISK APPENDIX

Not Applicable

BACKGROUND OF THE INVENTION

1. Field of Invention

The present invention relates to a very large area display for use in outdoor and stadium environment employing plasma display technology. More particularly, the present invention utilizes sub-blocks of tiles of plasma pixels that are specially designed to have high luminous efficiency.

2. Description of Prior Art

For large area, size of several feet in diagonal, display applications such as stadium display system, bill board display system and other outdoor and indoor display systems, several display technologies have been described. For example, Cathode Ray Tubes (CRTs), Fluorescent Lamps (FLs), Plasma Display Panels (PDPs) and fiber bundles carrying the light have been described in the prior art for these applications. These applications demand high performance of displays in terms of (i) brightness for readability under sunlight (ii) luminous efficiency (iii) planarity (iv) weight (v) ease of manufacturing (vi) Operation under temperature and humidity extremes.

In one prior art (U.S. Pat. No. 4,529,909), Kamegaya et.al described a gas discharge display panel that employed discrete anodes and cathodes arranged between two substrates orthogonally. The cathodes were hollow cathodes. For a very large screen display of several feet in diagonal, it is extremely difficult to deal with substrates of several feet and carry out processes on them in manufacturing. In another prior art (U.S. Pat. No. 4,833,542), Hara et.al described a large area display using CRTs as light emitting elements. As is well known, CRTs are bulky and heavy for such applications. Lowry et.al (U.S. Pat. No. 6,396,985) used fiber-optic bundles to transmit images from one end of the fiber bundle to the other end that was spread and terminated in a surface forming a tile-like structure. Lowry et.al employed optical lenses and refractive micro-lenses to preserve the image with minimum distortion. The image is generated at the dense end of the fiber bundle. This invention was mainly on optical communication of images in a large screen and by itself did not create display images. This was a bulky system with two sections comprising image generation and image communication and hence was bulky and complex in optical assembly. In another prior art (U.S. Pat. No. 5,095,244) Maeda et.al used fluorescent display tube as the main display screen. The fluorescent display tube was vacuum based flat CRT that employed control grid and focus electrodes to control the electron beam that impinged on Red, Blue and Green phosphors. This type of flat CRT is not suitable for several feet diagonal display and is heavy and bulky. Another prior art (U.S. Pat. No. 6,452,326 and US Patent Application No. 20040130252) by Xiaoqin Ge et.al employed discrete cold cathode fluorescent lamps (CCFLs) as picture elements (pixels). The display screen consisted of CCFLs of red color, blue color and green color assembled close to each other to form a color pixel. The CCFLs with several bends were assembled inside a flat vessel to be contained in a pixel format. The fill factor of each color was different inside the pixel. The CCFLs were scanned by incoming data to generate images. The disadvantage with this technique is the bulkiness and discrete nature associated with the whole display screen. In a publication (Tsutae Shinoda, Manabu Ishimoto, Hitoshi Yamada, Akira Tokai and Kenji Awamoto—"New approach for wall display with fine plasma tube array technology"—SID 02 Digest of Technical papers, pp. 1072-1075, SID 2002 International Symposium vol. XXXIII, No. 2, May 2002), Tsutae et.al described a large stack of linear plasma tubes as light generating pixel elements for very large area out door and indoor stadium type application. Electrodes were placed external to the plasma tubes and plasma was confined through the positioning of electrodes. In this configuration plasma diffused out of the confined region and further discrete tubes were bulky.

Another prior art (U.S. Pat. No. 5,668,443) by Kawaguchi et.al used discrete fluorescent lamps with coaxial geometry of electrodes. The tubes were assembled with ends-on with the light coming through a cylindrical tunnel. Most of the light loss occurred through multiple reflections as the light came from the inner surface of the coaxial cylinder to the end of the tube that formed the pixel. Several tubes were stacked end-on to form a pixel. This configuration was bulky and less efficient due to light loss. In a publication (Large area color display "Skypix"—Yoshiyasu Sakagauchi et.al, SID' 92 Digest of Technical papers, SID International Symposium, May 1991), Yoshiyasu Sakaguchi et.al described another cylindrical fluorescent lamp with hot cathode. In this configuration with end-on side acting as pixel, lot of light loss occurs with system being bulky due to the depth of cylindrical fluorescent lamps.

In all the foregoing arts, the thickness of the display was high and the display was bulky with discrete components. In some of them, the tiled concept was only at the final surface with increased thickness and bulkiness behind the tiles.

BRIEF SUMMARY OF THE INVENTION

According to the present invention, a large area plasma display incorporating planar plasma pixels with a novel design for increasing the luminous efficiency of the large area plasma display, coupled with ease of manufacturing of pixels sizes ranging from 6 mm×6 mm to 100 mm×100 mm and large area display sizes, comprising the large pixels sizes, ranging from 13'×10' to 210'×160' can be accomplished. The novel plasma pixels can be manufactured in large volume and individually assembled to derive a large area plasma display or multi-pixels can be volume manufactured in 'tiles' and 'tiles' can be assembled to generate very large area displays. Thus, the difficulty of handling large size substrates in manufacturing and huge investment in process machines to handle large area substrates can be eliminated. Luminance in the range of 1000 to 5000 nits can be obtained incorporating these pixels in the display and thus 'sunlight readable' displays for outdoor application can be realized.

The current invention of the large area display, incorporating the plasma pixels, employs a hybrid technology that combines the plasma display technology and the fluorescent lamp technology but with a major new design to increase the luminous efficiency of the display. The pixel comprises two plasma sustain electrodes, herein after called sustain electrodes, buried in a dielectric layer, on one substrate and an address electrode, also buried in a dielectric layer, on another substrate with phosphor coating on the substrate containing the address electrode. Between the sustain discharge electrodes is disposed a 'dielectric barrier' that creates a long positive column of plasma that is responsible for increasing the efficiency of the light out put. The pixel is filled with mercury and Argon gas or mixtures of Ar and Krypton or Argon and Helium. When suitable amplitude of voltage with appropriate frequency is applied between sustain electrodes, the inert gas and mercury will pass an electric current as a result of electrical breakdown and creation of plasma, causing the mercury to give off ultraviolet rays (253.7 nm and 185 nm). The plasma length is elongated by the presence of 'dielectric barrier', thus increasing the yield of ultraviolet rays. The ultraviolet rays cause excitation of phosphor resulting in light output from the pixel. Each pixel is fabricated as a device of dimension of the order of an inch and sealed with a frit seal. Hence the manufacturing becomes easy with simple machineries. Large area plasma display is generated by assembling these pixels in rows and columns. Alternately a group of pixels can also be fabricated on single panel in a 'tiled' configuration and the 'tiles' can be assembled to generate a large area display. Addressing of the display is by using the same scheme as employed in AC plasma displays.

It is an object of the present invention to provide a large area plasma display incorporating plasma pixel with a novel design. The novel pixel design enhances the luminous efficiency and readily manufacturable together with the large area plasma display derived from these pixels.

A further object of this invention is to provide a 'dielectric barrier' to the sustain discharge between sustain electrodes to augment the luminous efficiency of plasma pixels.

Yet another object of this invention is to incorporate dielectric reflective layer under the phosphor layer within a pixel to reduce visible and UV light losses.

Another object of this invention is to provide group of pixels in a single sealed panel called, 'tile' and assemble plurality of 'tiles' to fabricate large area plasma display for indoor and outdoor display system.

A further object of this invention is to eliminate the huge investment costs on process equipment required for handling large area substrates, using conventional method to manufacture large area plasma displays.

DETAILED DESCRIPTION

Figure 1:
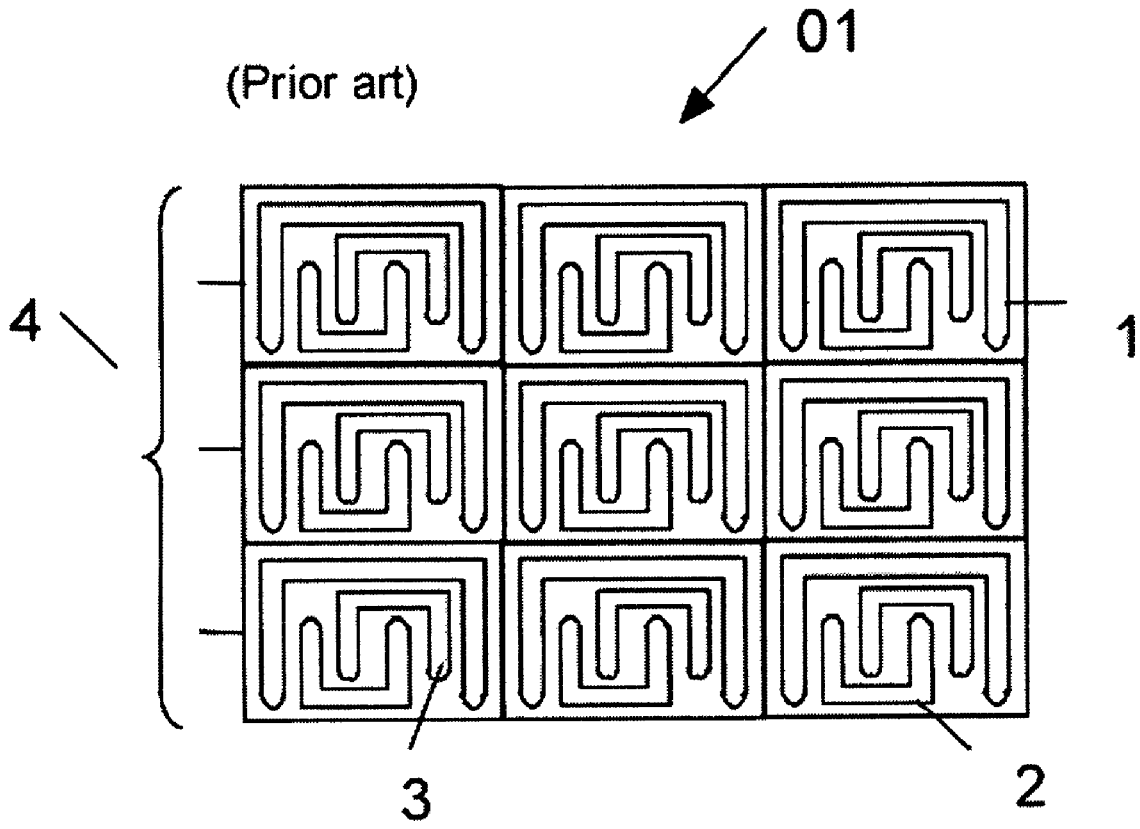
FIG. 1 is the plan view of a large area display of a prior art incorporating in every pixel three cold cathode discrete fluorescent lamps of red, blue and green color.

FIG. 1 shows the plan view of a large area display 01 incorporating discrete cold cathode fluorescent lamps, according to a prior art (U.S. Pat. No. 6,452,326), of red 1, blue 2 and green 3 color, assembled in one pixel in the format of matrix 4 with 3×3 pixels, as an illustration. In a large area display the pixels can be as many as 640×480. The cold cathode fluorescent lamps are U-type for accommodating inside the pixel. The construction is bulky and the pixel luminance will not be uniform for three colors because the three color lamps have different fill factors.

Figure 2:
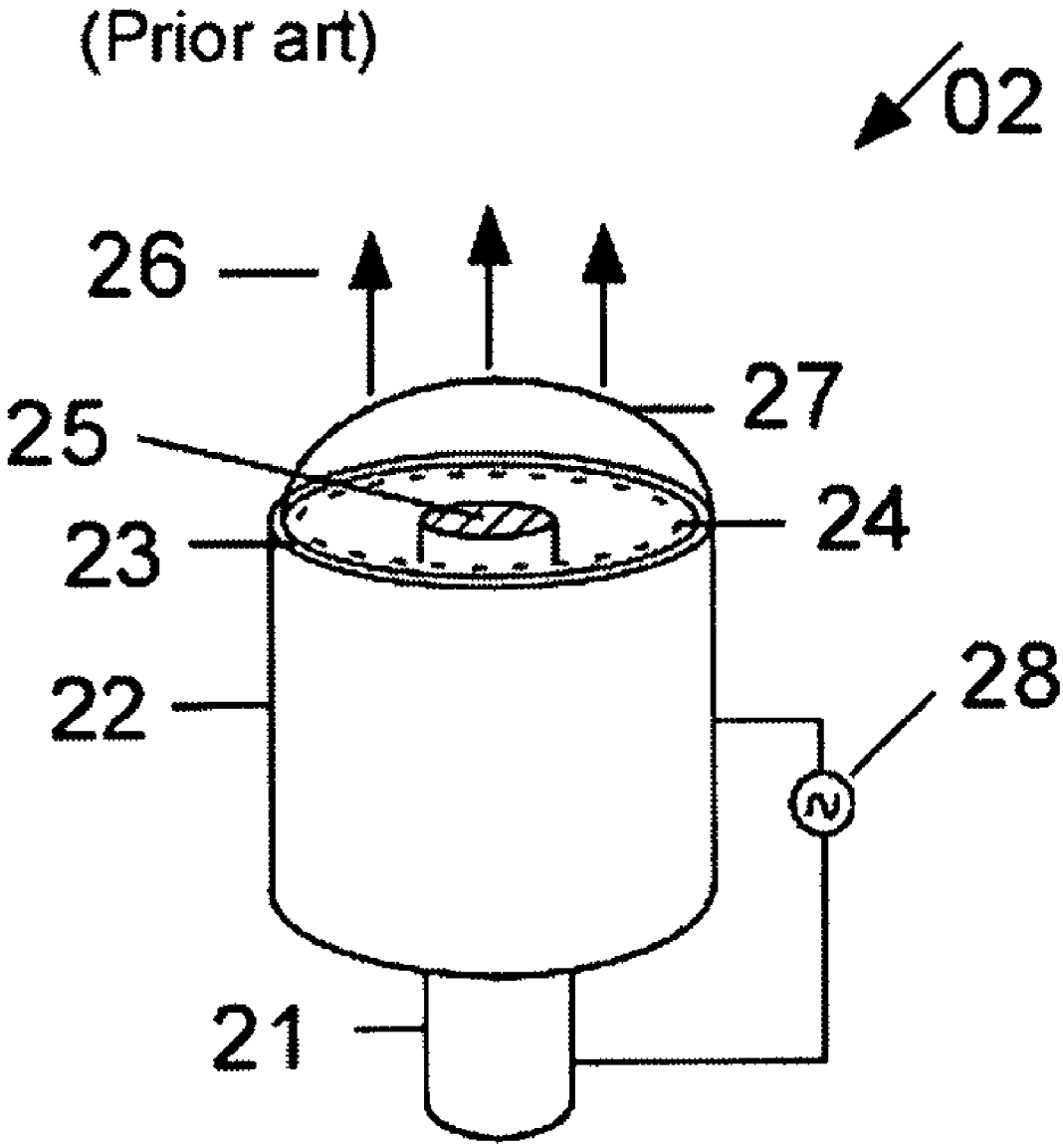
FIG. 2 is an isometric view of a coaxial cylindrical fluorescent lamp, according to a prior art, that forms part of the fraction of a pixel of a large area display.

FIG. 2 shows a discrete cylindrical fluorescent lamp 02, according to a prior art (U.S. Pat. No. 5,668,443) with its external outer electrode 22 and inner electrode 21 operated through an alternating voltage source 28. The outer electrode 22 has an insulation layer 23 followed by a phosphor layer 24. A similar insulation layer and phosphor layer (not shown in FIG. 2) are formed on the coaxial inner electrode 25. The plasma formed in the coaxial region produces UV that excites the phosphor layer. The resulting visible light 26 escapes through an optical lens 27.

Figure 3:
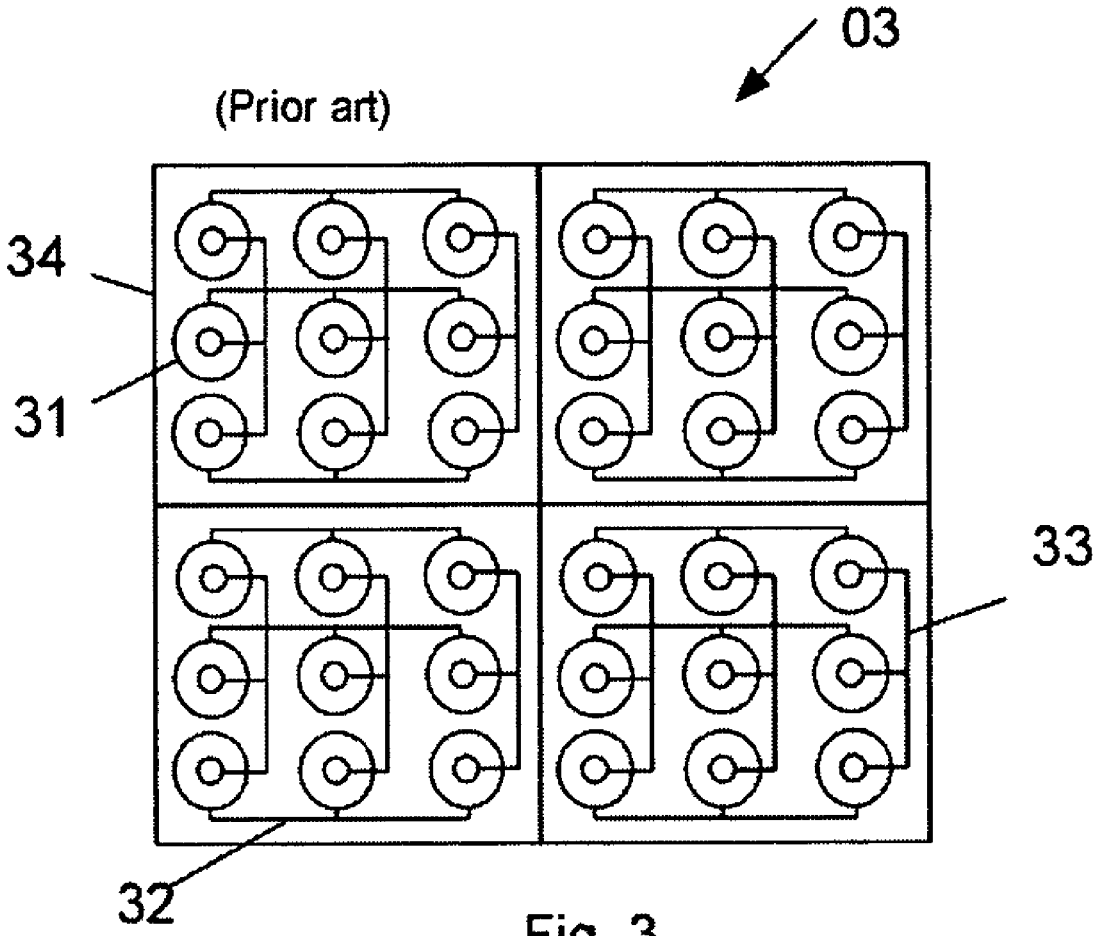
FIG. 3 is the plan view of a large area display employing plurality of end-on position of fluorescent lamp as depicted in FIG. 2.

FIG. 3 is the plan view of a large area display 03 formed by the plurality of discrete lamps shown in 2×2 matrix 34, as an illustration. In a large area display the number of pixels can be as many as 640×480. Every pixel in the illustration has nine of the lamps 31 and they are connected in parallel with outer electrodes 32 bussed together and inner electrodes 33 bussed together. The display derived from the use of discrete lamps as shown in FIG. 2 is bulky and the depth of the display is increased due to the height of the discrete lamp. The lamp itself is inefficient due to the light loss as a result of multiple reflections inside the coaxial geometry.

Figure 4:
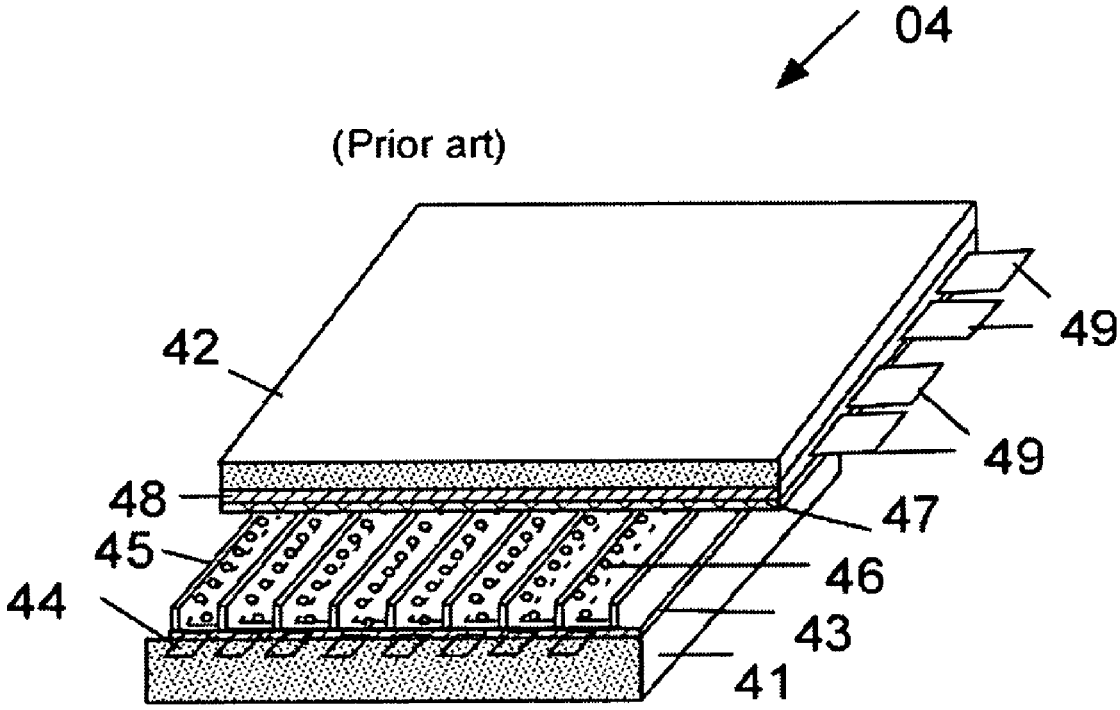
FIG. 4 is an exploded view of a medium sized (60" diagonal) plasma display of prior art showing the pixels processed on two substrates.

FIG. 4 illustrates another prior art in which a large area display 04 is built on two large substrates through integral processing. The bottom substrate 41 contains plurality of address electrodes 44 buried under a dielectric layer 43 followed by phosphor layer 46 between the ribs 45 that isolate pixels from 'cross talk'. The top substrate 42 contains sets of sustain electrodes 49 buried in a dielectric layer 48 followed by an electron secondary emission enhancement layer 47. In a regular display there is a momentary gas discharge established between address electrode 44 and one of the sustain electrodes 49 and the gas discharge is sustained by sustain electrodes 49. The UV from the discharge excites the phosphor and the resulting visible light output enables the display. This art suffers from the fact that large area displays, ranging to several tens of feet in diagonal, are difficult to make because of handling of very large substrate sizes and the expensive special purpose machinery needed to handle these substrate sizes.

Figure 5:
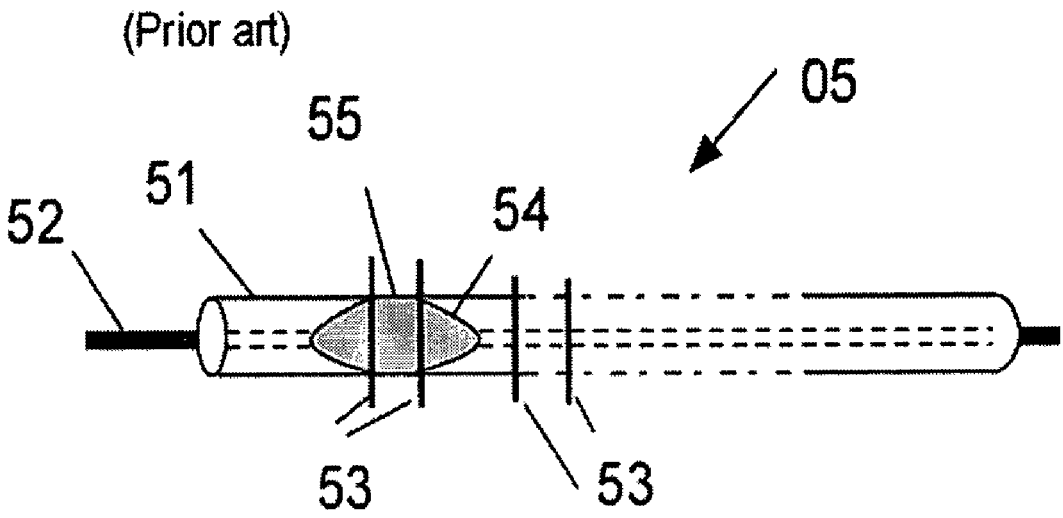
FIG. 5 is the side-view of discrete cylindrical plasma tube with plasma sustain-electrodes and address electrode defining a pixel on the tube.

FIG. 5 illustrates a plasma tube 05, the basic light emitting element, of a large area plasma display (Tsutae Shinoda et.al, SID' 02 Digest of Technical papers) that has plurality of sustain electrodes 53 vertical to the tube axis along its length, outside the tube, and an address electrode 52, outside the tube, parallel to the axis of the tube. Plasma 55 is formed between sustain electrodes 53 when suitable voltage is applied between the sustain electrodes. As could be seen, the plasma diffuses 54 laterally along the axis of the tube thus not confining to the region between the sustain electrodes and resulting in cross-talk and low resolution. This is the drawback in this art.

Figure 6:
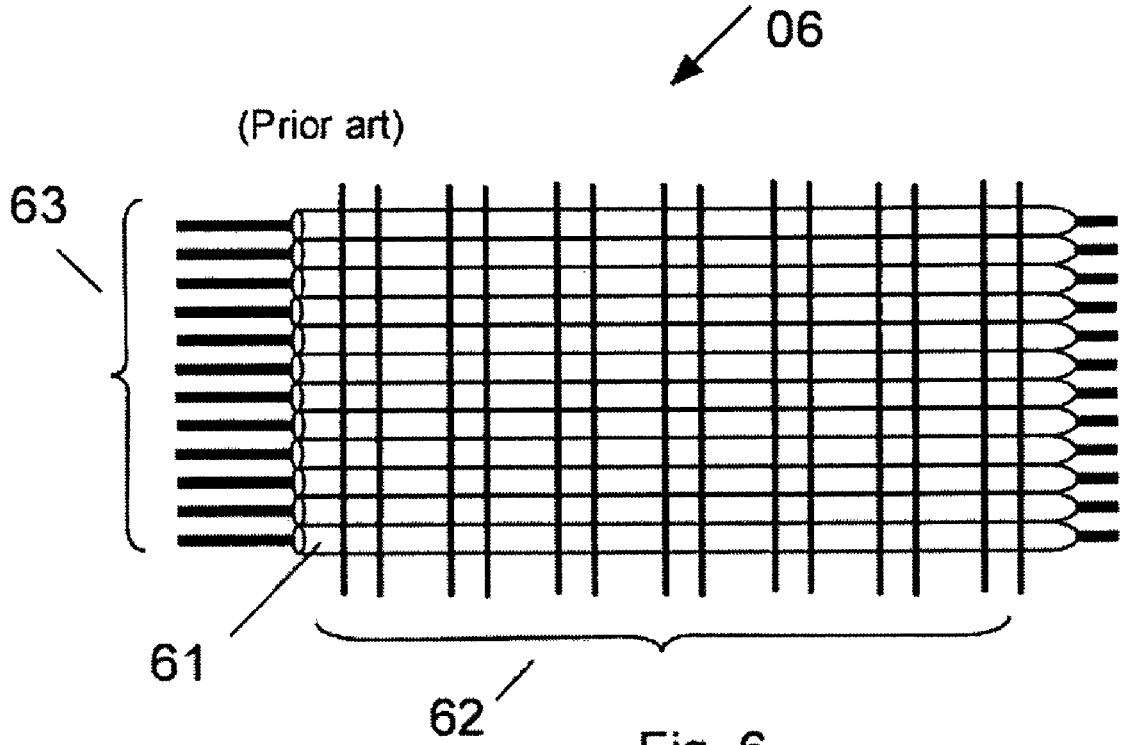
FIG. 6 is the front view of a large area plasma display containing plurality of plasma tubes depicted in FIG. 5.

FIG. 6 shows a large area plasma display 06 incorporating plurality of plasma tube depicted in FIG. 5. The sustain electrodes 62 define the pixels along the plurality of plasma tube 61 and address electrodes 63 selects the pixels as per the incoming data to the display. The main disadvantage of this art is the diffusion of plasma from the pixel region thus not defining the pixel and leading to 'cross talk' problems.

Figure 7:
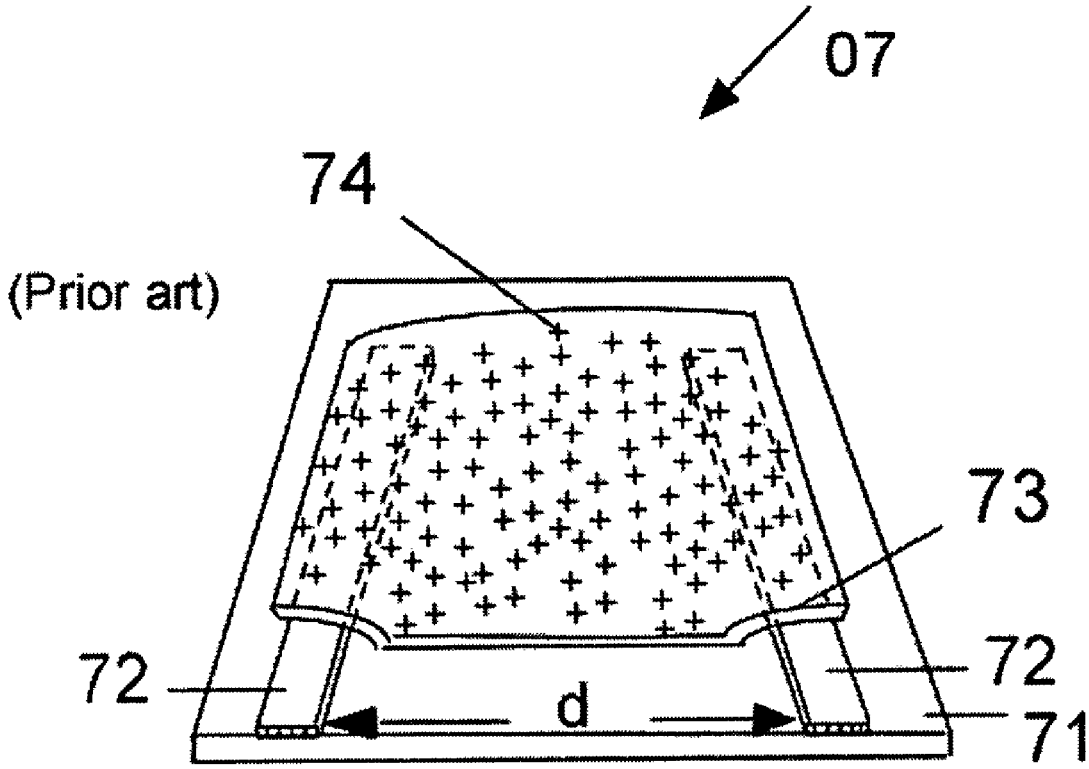
FIG. 7 is the isometric view of one of the substrates of a pixel, containing two sustain electrodes, according to a prior art, covered by a dielectric layer.

FIG. 7 illustrates the substrate 07 containing sustain electrodes 72 of a conventional plasma display (refer FIG. 4) on a glass plate 71, buried under a dielectric layer 73 and separated by a liner gap of 'd'. On top of the dielectric layer is coated a layer 74 of MgO to enhance electron secondary emission.

Figure 8:
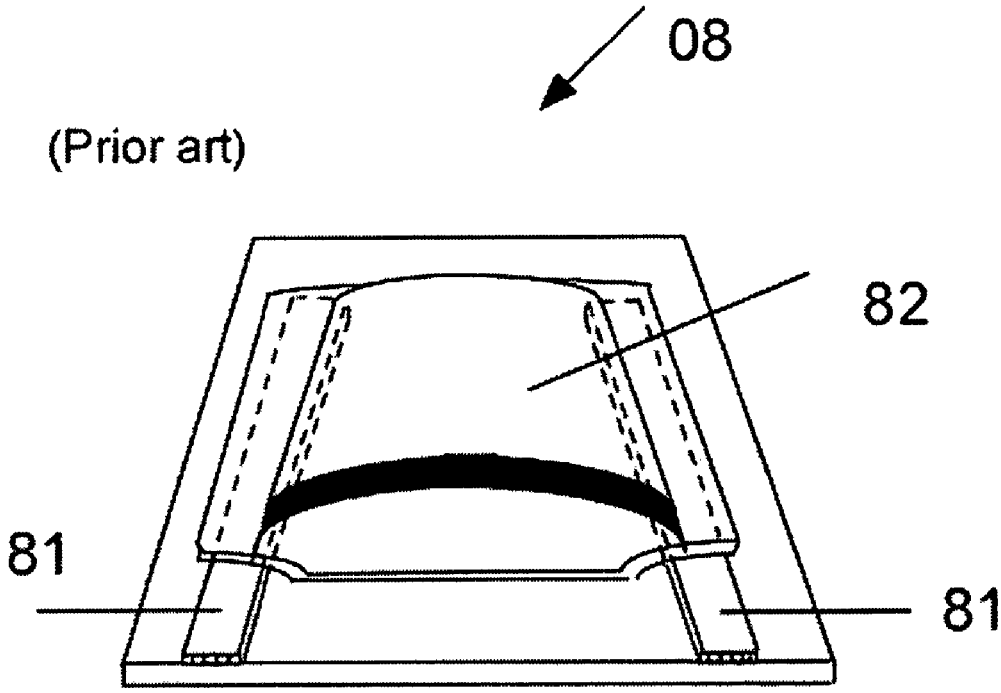
FIG. 8 is the isometric view of plasma path between two sustain electrodes shown in FIG. 7.

FIG. 8 shows the substrate 08 depicting the curved path of plasma 82 between the sustain electrodes 81 when sufficient voltage is applied between the sustain electrodes to create a gas discharge.

Figure 9:
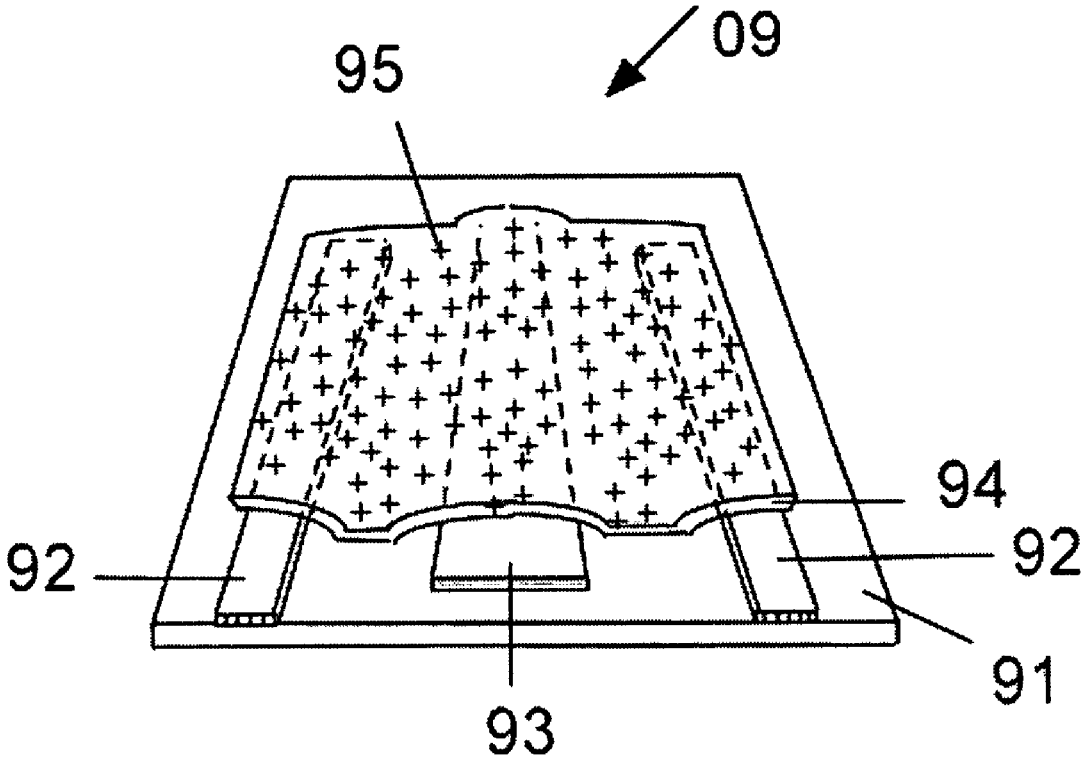
FIG. 9 is the isometric view of one of the substrates of a pixel, according to the present invention, where there is a dielectric barrier between the sustain electrodes.

FIG. 9 shows the substrate 09, according to the present invention, that contains a dielectric barrier 93 on a glass plate 91, in addition to the sustain electrodes 92. The sustain electrodes and dielectric barrier are coated with a thin layer of dielectric 94 followed by an electron secondary emission enhancement layer 95. The sustain electrodes 92 are made from Indium Tin Oxide (ITO) through a sputtering process or thermal CVD process to obtain a thickness in the range of 50 nm to 150 nm and the resistivity in the range of 10Ω/to 100Ω/to have high optical transmission of >85%. A resist lift-off process can be used to pattern the ITO layer to the desired dimension, if the ITO is deposited by sputtering. If the ITO is deposited by thermal CVD, a photo-lithographic etch process can be employed. For contacting to the drive electronics, the sustain electrodes 92 are terminated by screen-printed silver conductor (not shown in FIG. 9), employing 'Dupont's' 7713 silver conductor and thermally firing the print. An alternate material is 'Dupont's' Fodel DC201 which can be employed for photo-lithographically forming the termination. The thickness of the Ag layer can be in the range of 12 microns to 25 microns. The dielectric barrier 93 can be a rectangular or circular glass rod of thickness/diameter of approximately in the range of 2 mm to 5 mm that can be sealed to the glass plate 91 through a dielectric layer. The dielectric layer 94 can be obtained by screen printing 'Dupont's' DG211 Fodel dielectric paste or 'Cermalloy 9000' glass mixed ceramic dielectric paste or dielectric material from 'Hanwook' or dielectric material from 'Sunchon' and thermally firing the print to a temperature of 550 C. The thickness of this layer is in the range of 10-25 microns. The MgO layer 95 can be obtained by e-beam deposition of MgO in vacuum to a thickness of approximately 10,000 A or the MgO can also be deposited through reactive sputter deposition using Ar and Oxygen during sputtering.

Figure 10:
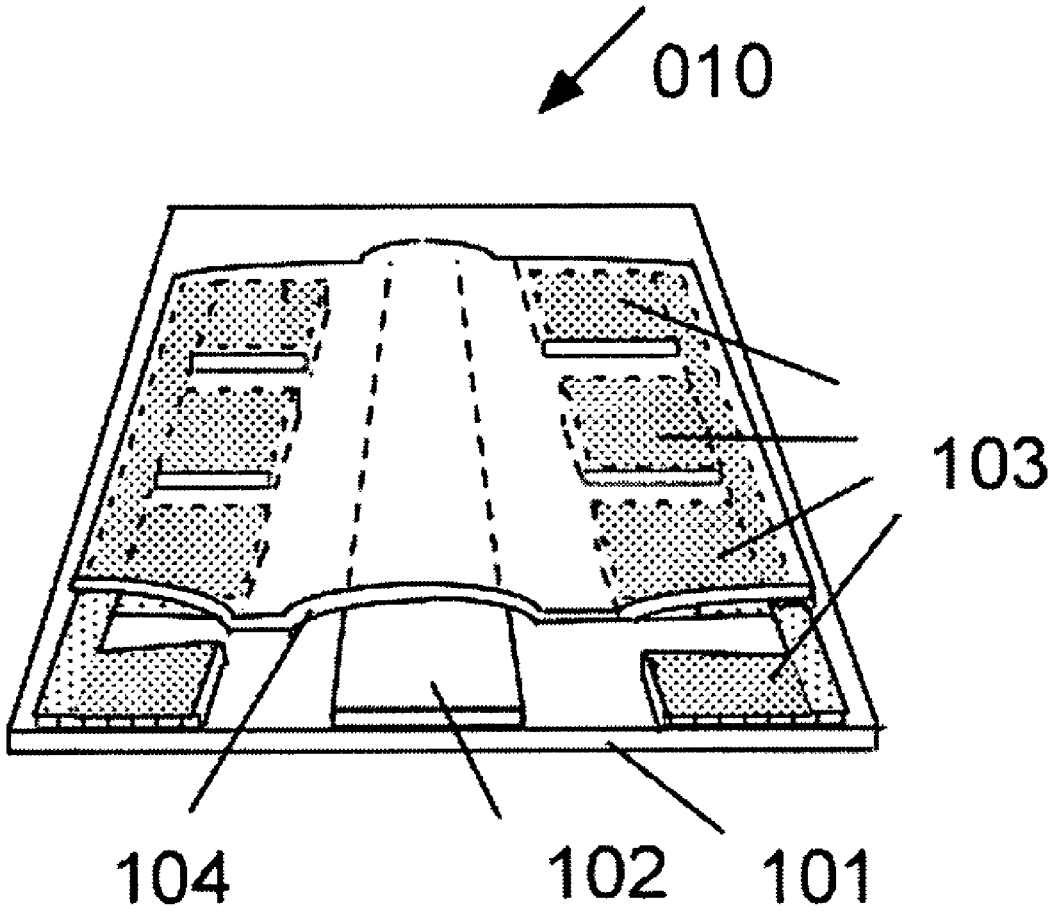
FIG. 10 is the isometric view of one of the substrates of a pixel, with an alternate split structure of sustain electrodes.

FIG. 10 presents substrate 010 with an alternate sustain electrodes 103 with split structure formed on glass plate 101 on either side of a dielectric barrier 102. Both the sustain electrodes and dielectric barrier are coated with a thin layer 104 consisting of a thin dielectric layer followed by a secondary electron emissive layer. The split sustain electrode arrangement will give the advantage of well spread out uniform plasma.

Figure 11:
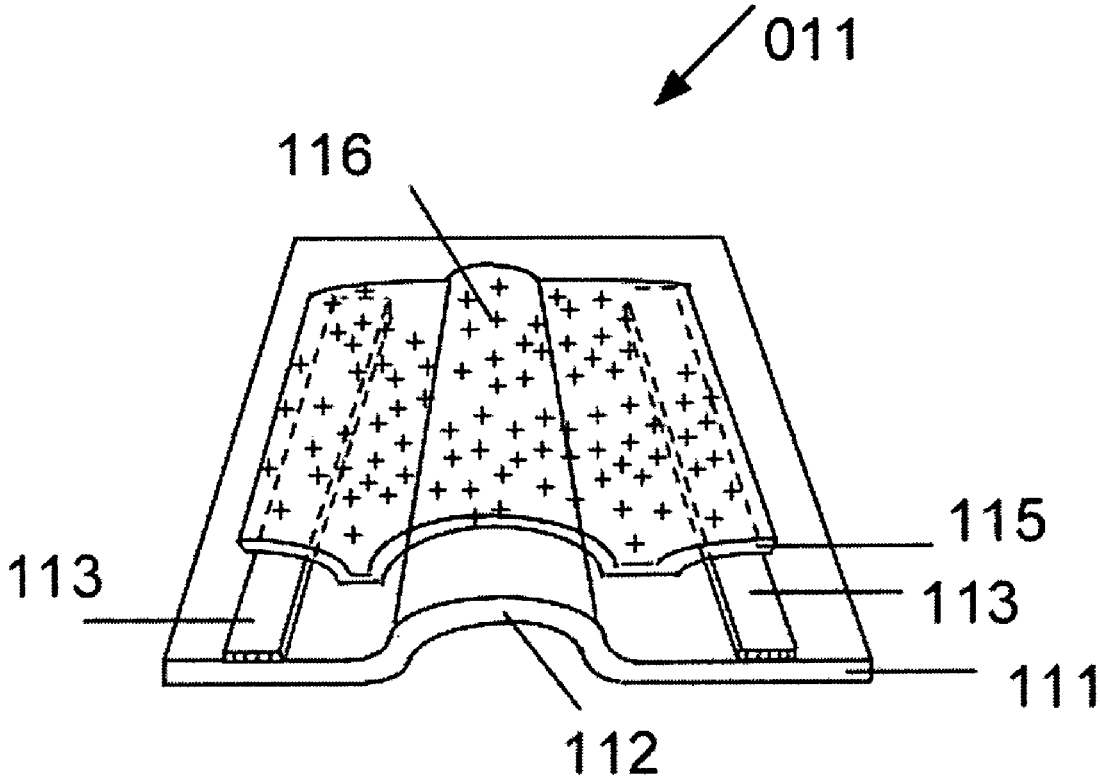
FIG. 11 is the isometric view of one of the substrates of a pixel with an alternate dielectric barrier, between two sustain electrodes, integral to the substrate.

FIG. 11 presents an alternate substrate 011 with a corrugation 112, according to the present invention, that is integral to the glass plate 111. The corrugation creates a 'bump' for the discharge path between sustain electrodes 113 which are coated with a dielectric layer 115 followed by electron secondary emission enhancement layer 116.

Figure 12:
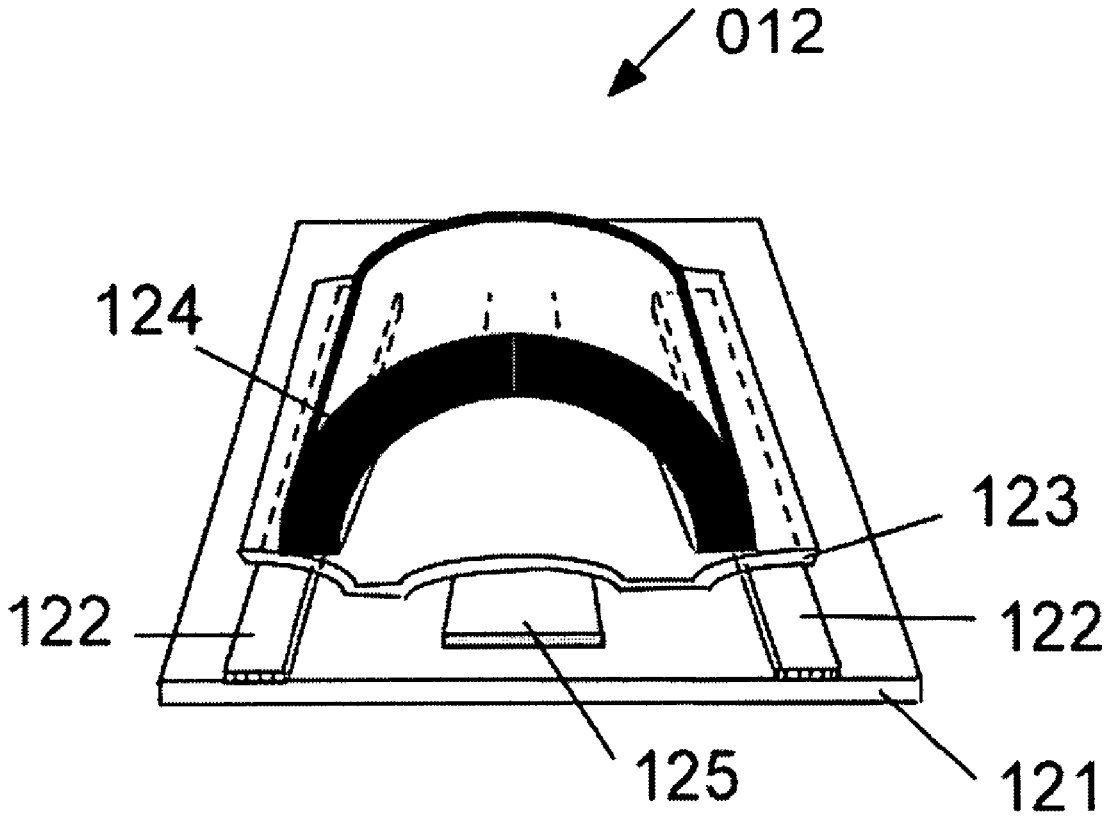
FIG. 12 is the isometric view of plasma path between two sustain electrodes contained on the substrate depicted in FIG. 9.

FIG. 12 shows the substrate 012 with a plasma path 124 created as a result of application of suitable momentary plasma initiation voltage between address electrode and one of the plasma sustain electrodes and then maintaining an alternating voltage between the sustain electrodes 122 which are covered by a layer 123 consisting of a dielectric layer and an electron secondary emission enhancement layer. The presence of dielectric barrier 125, laid on glass plate 121, makes the plasma path more curved upwards compare to the plasma path in FIG. 8. The increase in the path length of plasma increases the luminous efficiency of the plasma pixel and consequently the luminous efficiency of large area plasma display that comprises the plurality of these plasma pixels.

Figure 13:
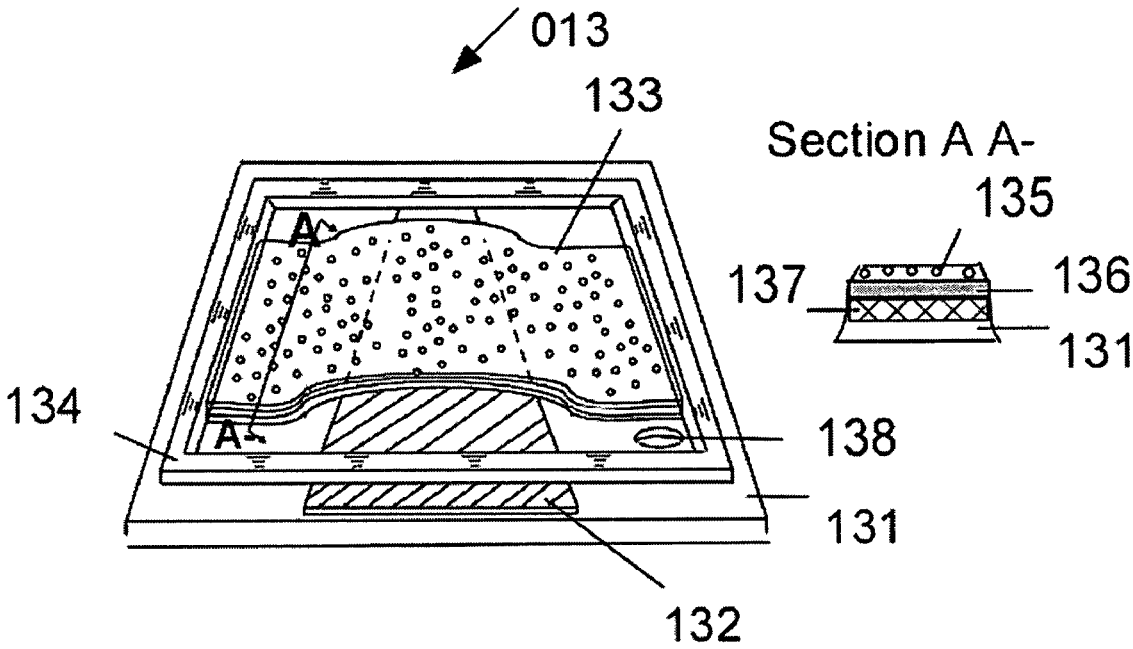
FIG. 13 is the isometric view of one of the substrates of a pixel, according to the present invention, containing address electrode covered by a dielectric layer followed by a dielectric reflective layer followed by a phosphor layer and finally a peripheral seal layer.

FIG. 13 presents various processed parts of substrate 013, according to the present invention, that contains starting from the glass plate 131, an address electrode 132 followed by multi-layer 133 comprising a thin dielectric layer 137 followed by a dielectric reflective layer 136 followed by a final phosphor layer 135. There is an evacuation and gas filling-hole 138 and the substrate is finally applied with a peripheral sealing frit layer 134. The address electrode 132 can be made by screen printing 'Dupont's' silver paste 7713 or 'Dupont's' Fodel DC201 and firing to a temperature of 550 C. An alternate material is a thin film stack of Cr—Cu—Cr or Cr—Al—Cr through vacuum deposition. If formed by screen printing the thickness of silver electrode is in the range of 12 micron to 25 micron and if formed by thin film deposition the thickness of the electrode is in the range of 1000 nm to 2000 nm and the width being in the range of several mm. A thin dielectric layer 137 is printed over the address electrode and processed in the manner described before for the dielectric layer on sustain electrodes. The reflective dielectric layer 136 can be obtained through the process of screen printing Aluminum Oxide paste or spraying the suspension containing Aluminum Oxide and firing to a temperature of 550 C. An alternate method is by printing a low melting glass paste mixed with Titanium dioxide or Aluminum Oxide or SrTiO3 or ZrO2 and firing to a temperature of 550 C. Still another alternative method is to screen print the reflective Titanium Dioxide or Aluminum Oxide or SrTiO3 or ZrO2 mixed glass paste as a single layer to replace layer 136 and 137 and firing to a temperature of 550 C to obtain a thickness in the range of 25 to 40 microns. The final phosphor layer is obtained by employing phosphor pastes of desired color and screen printing and firing to a temperature of 500 C to result in a thickness range of 12-18 microns. The phosphor material is Zn2 SiO4:Mn for green, BaMgAl10 O17:Eu for blue and Y2 O3:Eu for red. To derive green, blue and red pixels these phosphor materials can be used. Alternate materials for green are YBO3:Tb and BaAl12 O19:Mn and for red (Y, Gd)BO3:EU and YBO3:Eu. An alternate method for phosphor deposition is by spraying a suspension of phosphor. The peripheral seal layer can be deposited employing a rectangular glass frame, coating the frame with low melting glass frit paste and placing the coated frame on the glass plate 131 and pre-glazing to a temperature of 450 C.

Figure 14:
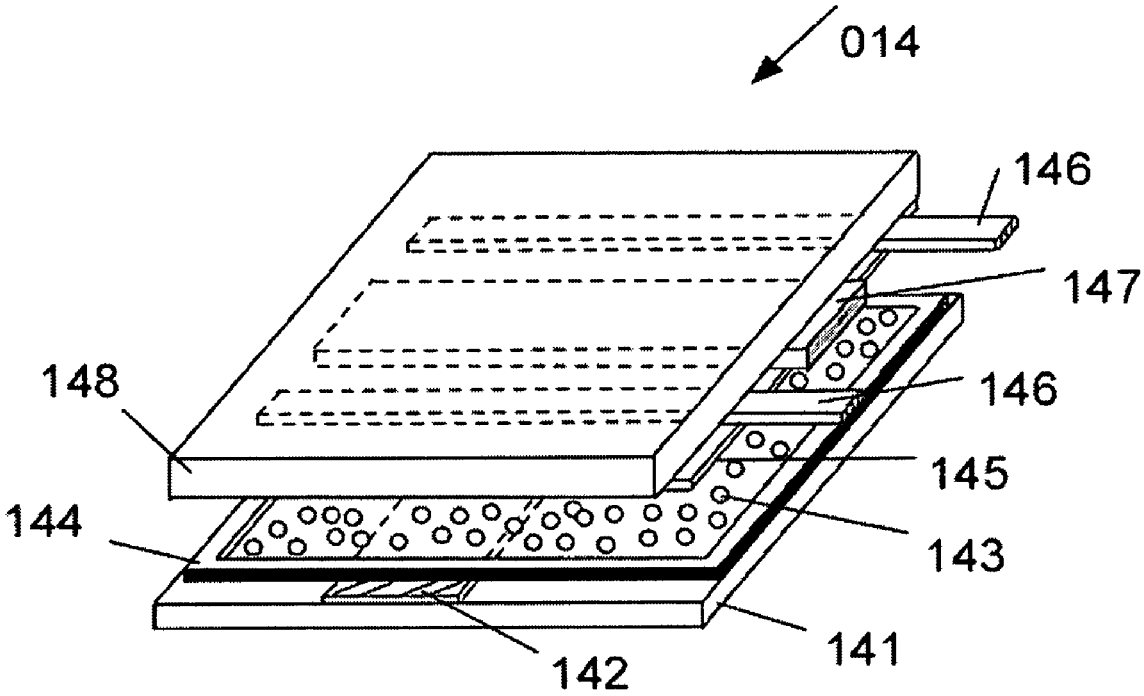
FIG. 14 is the exploded view of two substrates forming a pixel, according to the present invention, depicting the sustain electrodes with a dielectric barrier on one substrate and address electrode on the other substrate.

FIG. 14 depicts the assembly 014 of bottom substrate 141 with top substrate 148 for alignment prior to sealing the two substrates. The sustain electrodes 146 are orthogonal to the address electrode 142. Within the seal frame 144 are the phosphor layer 143 with its backing layers of dielectric and reflective dielectric layer (not shown in FIG. 14). The key dielectric barrier 147 with the transparent dielectric overlayer 145, including the electron secondary emission enhancement layer (not shown in FIG. 14) are contained on the top substrate 148.

Figure 15:
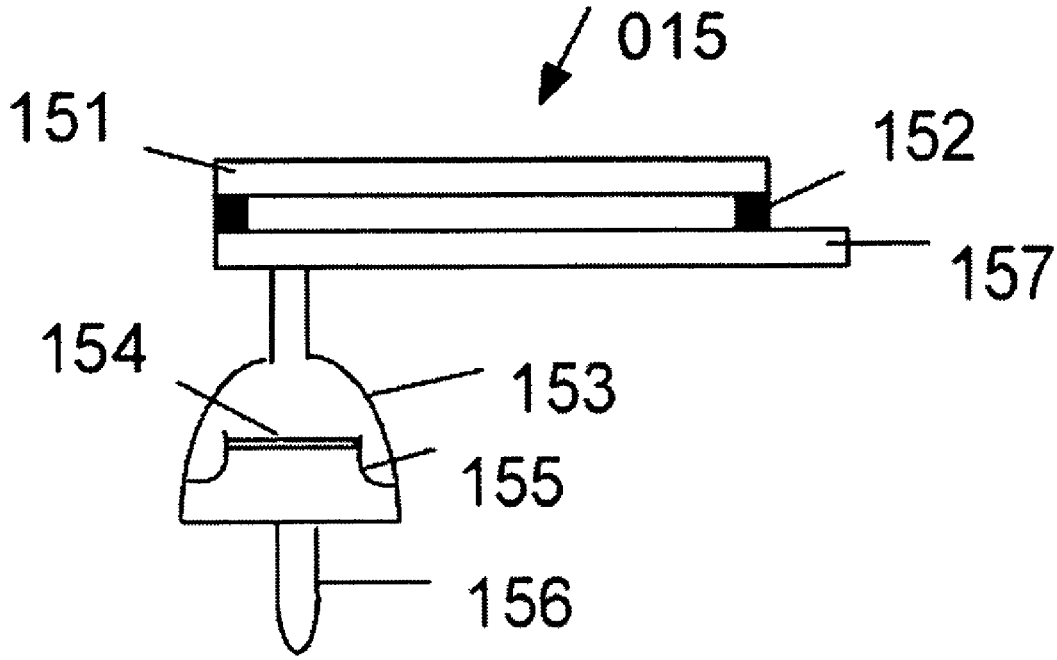
FIG. 15 is the cross sectional view of a sealed pixel, comprising the two substrates depicted in FIG. 14, with a mercury dispensing arrangement.

FIG. 15 shows the cross section 015 of a single pixel in sealed configuration with a mercury reservoir 153 appended to the bottom of the single pixel panel. The top substrate 151 is sealed to the bottom substrate 157 through the frit seal 152. The frit seal is made employing a low melting glass frit and sealing it around 500 C. The mercury reservoir 153 with its mercury dispensing getter 154 can be obtained form 'Saes' getters corporation, containing Zirconium and mercury. The mercury reservoir is attached by flame sealing, after frit sealing the single pixel panel. The whole panel is evacuated through the exhaust tabulation 156 (not closed at this time, but shown as closed in FIG. 15 at the end of evacuation cycle) and baked to a temperature of 350 C and filled with inert gas mixture containing 90% Ar and 10% He. Alternate gas mixtures are 90% Ne/10% He or 50% Ne and 50% Ar. The pressure of the gas filling is in the range of 3 torr to 100 torr. After gas filling the exhaust tabulation is tipped off and closed as shown in FIG. 15. The mercury dispensing getter 154 is induction heated, through a high frequency coil coupled to a high frequency generator without heating the getter support 155, to a temperature of 900 C to release free mercury and activate the Zirconium getter. After this stage, the panel assembly 015 is placed in a slotted oven to immerse only the mercury reservoir portion of the panel inside the oven slot and the temperature of the reservoir is raised to 300 C for driving the mercury droplets formed during the induction heating process to the space between the substrates 151 and 157. At the end of this process, the mercury reservoir is detached from the panel.

Figure 16:
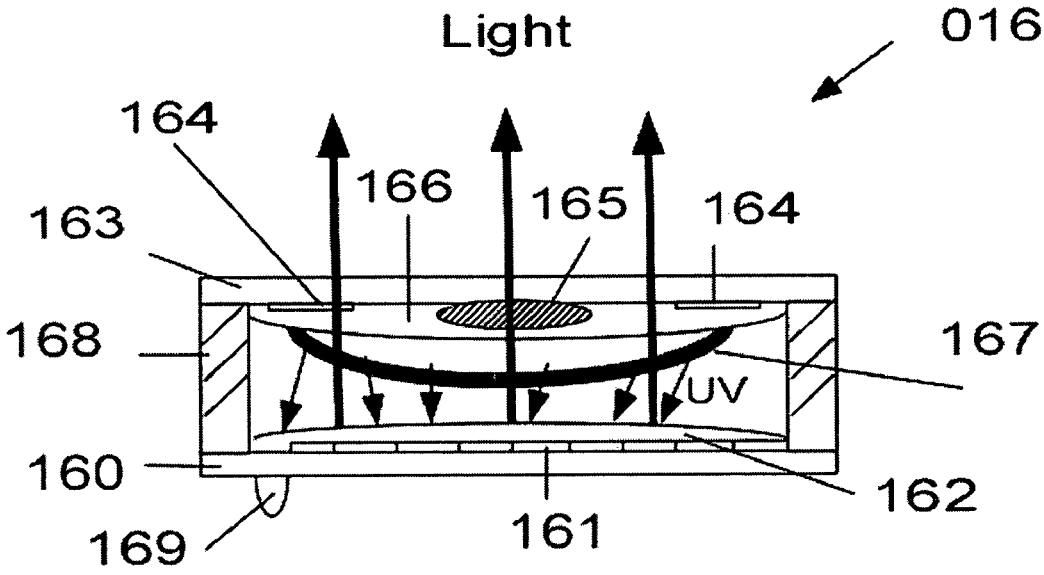
FIG. 16 is the cross sectional view of a processed pixel cell, according to the present invention, showing various parts of the pixel, including the path of plasma.

FIG. 16 is the cross section of the single pixel panel 016 after vacuum processing, gas filling and mercury filling. For the sake of simplicity several layers are omitted in this FIG. 16. For example, above the address electrode 161, the dielectric layer, dielectric reflective layer and phosphor layer are combined and shown as a single layer 162. Similarly, over the sustain electrodes 164 and the dielectric barrier 165, thin film dielectric layer and MgO layer are combined and shown as a single layer 166. The bottom substrate 160 and top substrate 163 are sealed through a frit seal 168 and the exhaust tabulation 169 is tipped off. The path of Ar—Hg plasma 167 is formed when a sufficient magnitude of voltage is applied between the sustain electrodes 164. As can be seen the path of plasma is sufficiently curved downwards due to the presence of dielectric barrier and the substantial UV generated due to increased path length of plasma excites the phosphor that results in visible light escaping the panel upwards.

Figure 17:
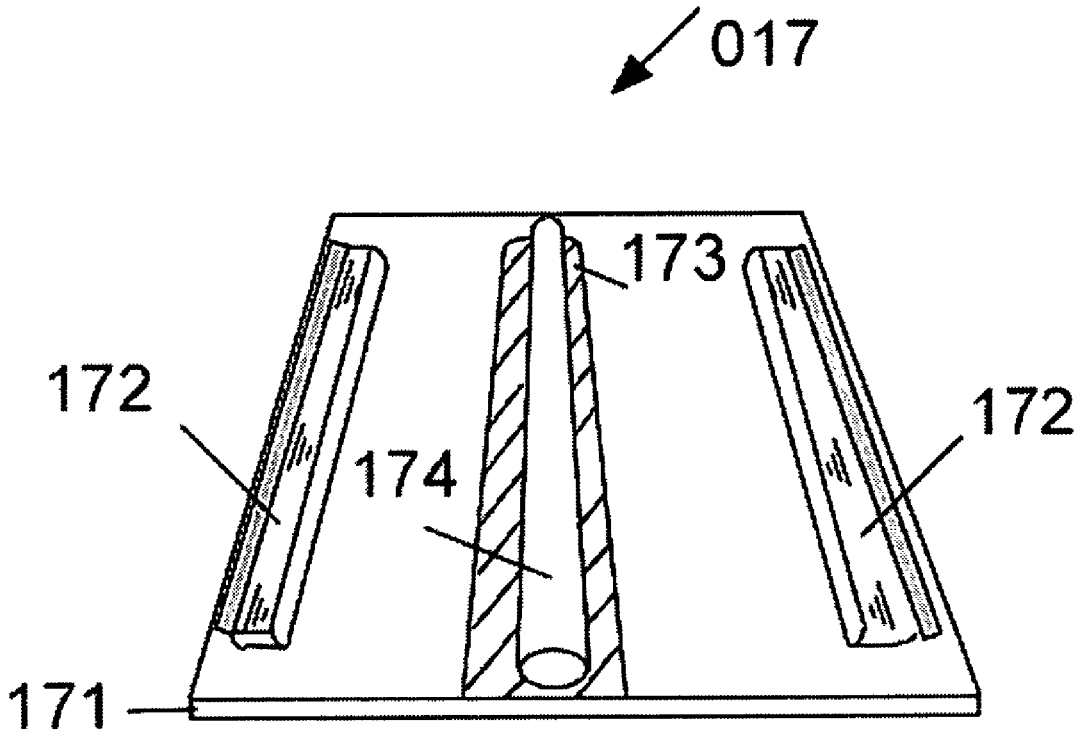
FIG. 17 is the isometric view of one of the substrates of a pixel with alternate design, according to the present invention, of sustain electrodes and dielectric barrier between two sustain electrodes.

FIG. 17 illustrates an alternate design 017 for the sustain electrodes and dielectric barrier. The substrate 171 through which the visible light escapes contains rectangular hollow electrodes 172 as sustain electrodes and the dielectric barrier 174 is fixed to the substrate 171 through a glass frit 173.

Figure 18:
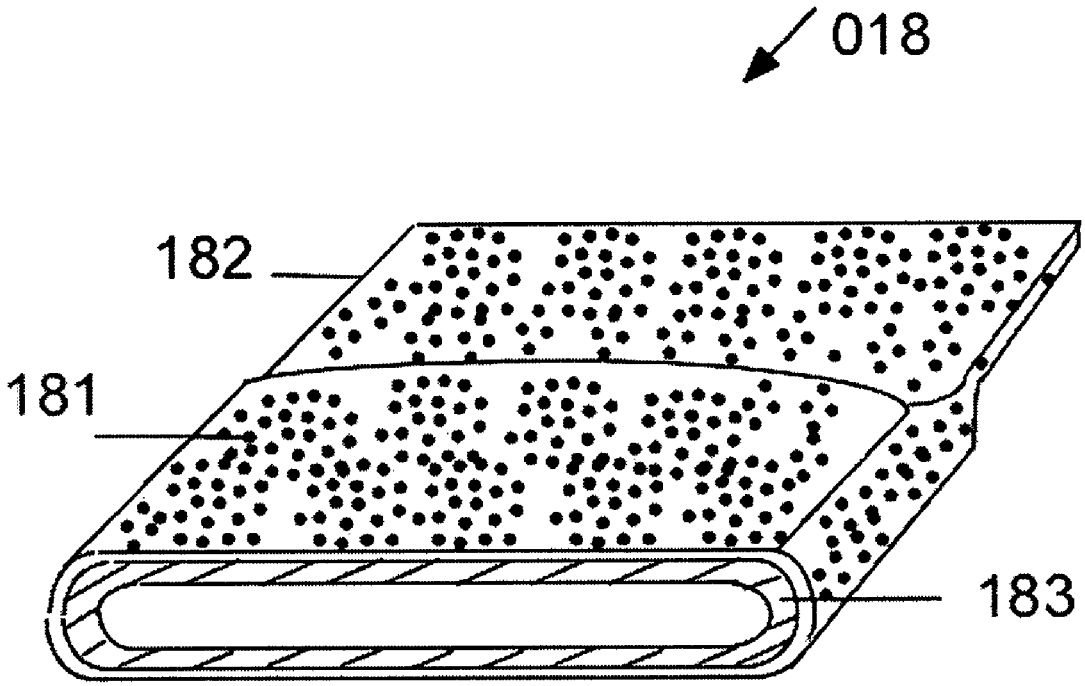
FIG. 18 is the isometric view of one of the sustain electrodes depicted in FIG. 17, according to the present invention.

FIG. 18 shows the details of the hollow electrodes that are used as sustain electrodes. The rectangular hollow electrode 183 has two portions of external surface. One surface 181 below which is situated the hollow geometry and another surface 182 which is pinched to be flat for compatibility for peripheral seal of the single pixel panel. The material of the electrodes can be an alloy of Nickel-Iron alloy called 'Alloy 42' (52% Ni and balance Fe with traces of Cr, carbon etc,) or 'Alloy 52', (52% Ni and balance Fe with traces of Cr, carbon etc.,) that are good for frit-sealing to the soft glasses. External surface of the hollow electrode 181 and 182 is applied with a coating of vitreous glass frit by spraying and thermally pre-glazing to a temperature of 400 C to form a continuous layer of frit glass. The horizontal axis of the hollow structure is tilted to make a small angle with the plane of the plate (172 of FIG. 17). This angle can range between 10 degrees to 45 degrees. The inside of the hollow electrode can also be coated with a low work function material such as Barium oxide, or cerium oxide or lithium fluoride or mixtures of Ba, Sr and Ca oxides in the ratio of 50:40:10.

Figure 19:
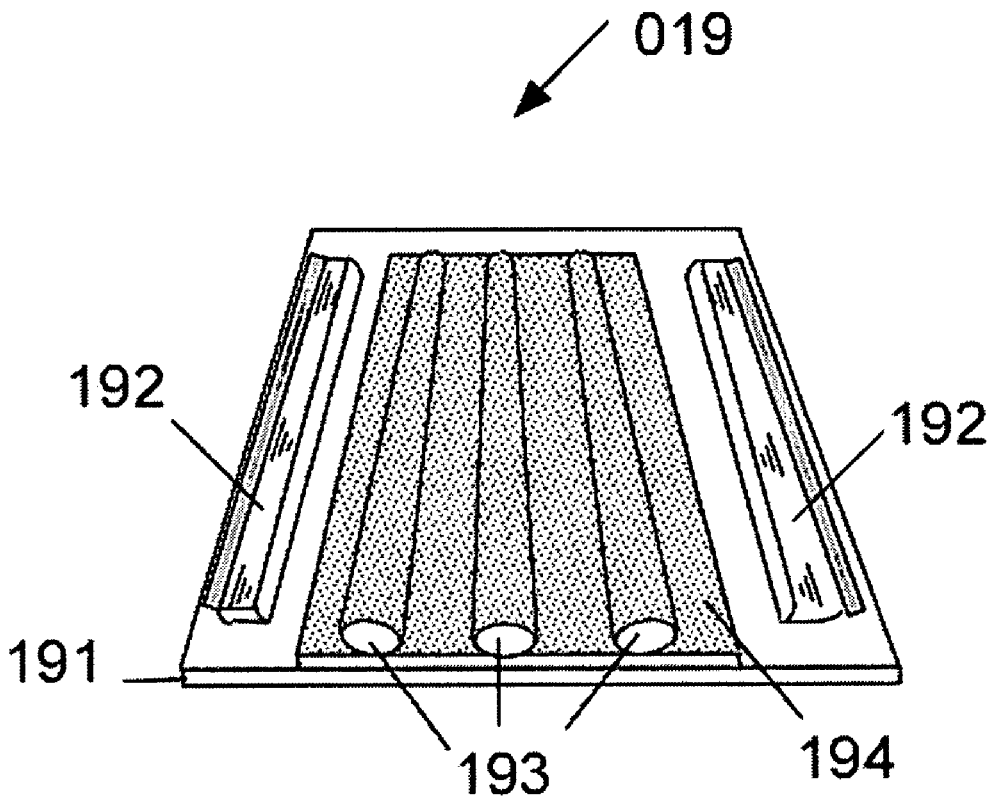
FIG. 19 is the isometric view of one of the substrates of a pixel with another alternate design of dielectric barrier between two sustain electrodes.

FIG. 19 illustrates an alternate design 019 of the dielectric barrier with plurality of dielectric rods 193 sealed in the glass plate 191 through glass frit layer 194 between hollow sustain electrodes 192. This type of barrier will further increase the path length of plasma resulting in enhanced luminous efficiency of large area display. An alternate design for the dielectric barrier can be the 'corrugated bump' structure shown in FIG. 10.

Figure 20:
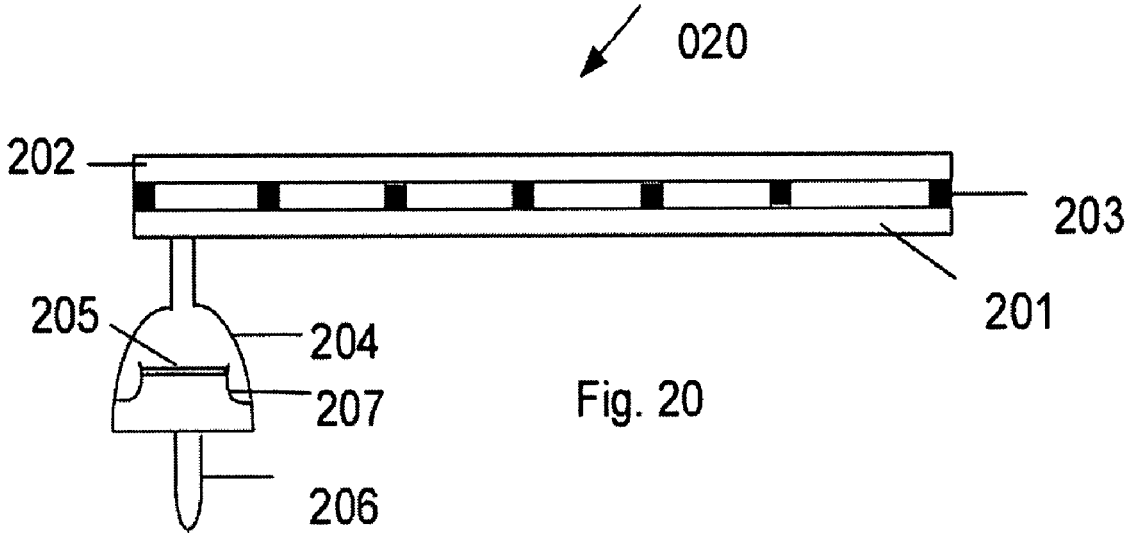
FIG. 20 is the cross sectional view of plurality of pixels sealed between two substrates, according to the present invention, with mercury dispensing arrangement.
Figure 21:
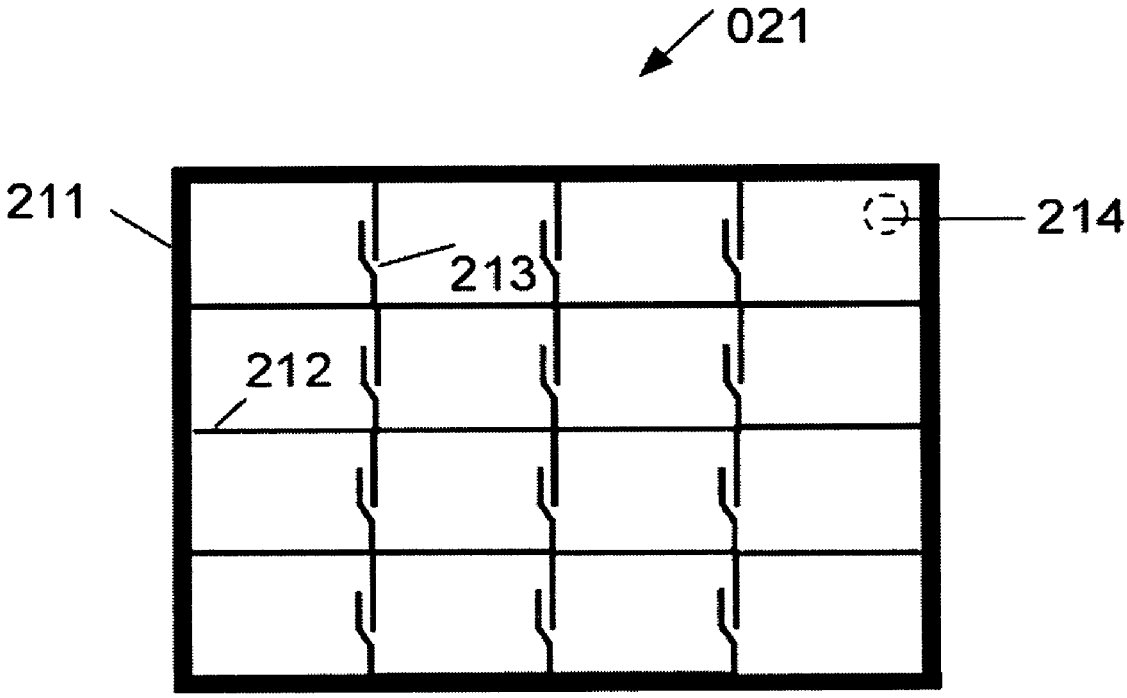
FIG. 21 is the plan view of plurality of pixels sealed between two substrates, according to the present invention.

FIG. 20 depicts plurality of plasma pixels 020 formed between two substrates 201 and 202 with the frit seal 203 separating them to prevent cross-talk but still connecting them for the purpose of evacuation and gas filling (better seen in FIG. 21). The mercury reservoir 204 with its mercury dispensing getter 205 with its support 207 and the evacuation tube 206 play the same role as in FIG. 15. In this configuration, the multiple plasma pixels between two substrates act like tiles for the large area display but the panel is still small enough for simplicity in handling.

FIG. 21 is the plan view 021 of FIG. 20 with the mercury reservoir detached. The glass frit seal 211 is all the way around for the entire panel except for the individual pixels. For the individual pixels the glass frit seal 212 is not closed but with an opening 213 in the form of a barrier. This opening links all the pixels during evacuation and gas filling through a common hole 214. The restricted opening 213 prevents cross-talk between pixels.

Figure 22:
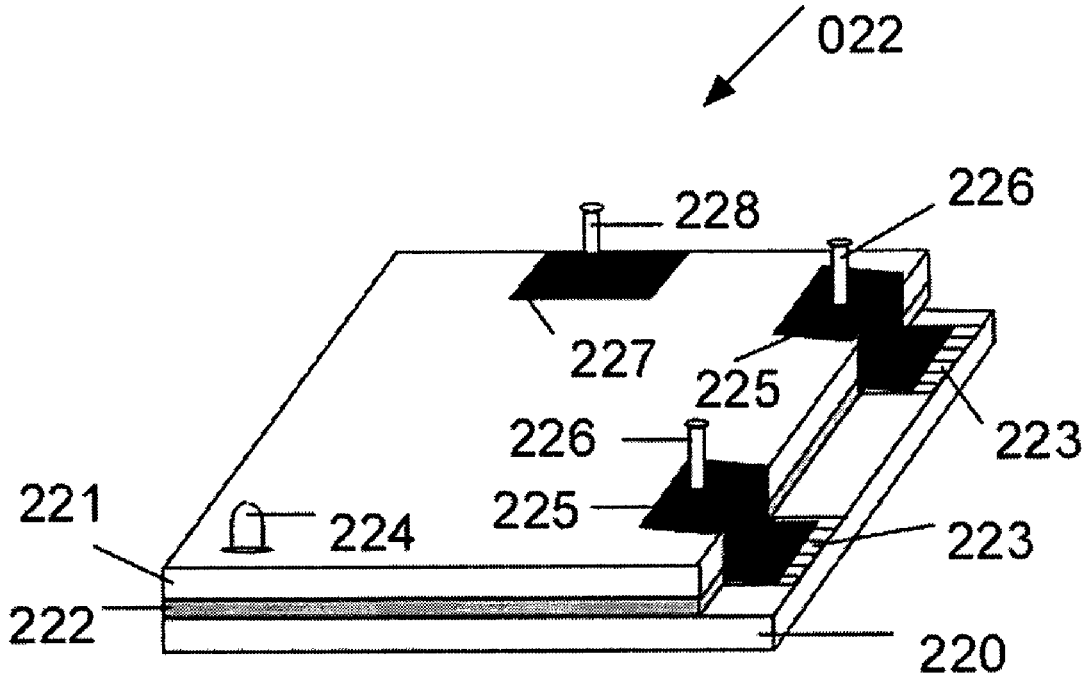
FIG. 22 is the isometric view of the assembly of single pixel, according to the present invention, with lead out for electrical connection.

FIG. 22 illustrates the assembly 022 of a single pixel plasma panel prior to its main frame assembly. The sustain electrode terminations 223 on the larger glass plate 220 are conducted to the external surface of the smaller glass plate 221 through a conductive silver epoxy 225 that contains pins 226 herein after called sustain electrode pins. The address electrode termination (not shown in FIG. 22) is similarly brought to the address electrode pin 228. The sealed off evacuation hole is protected by a plastic cover 224 is seen on the external surface of glass plate 221. The side through which the light escapes is the bottom side of glass plate 220.

Figure 23:
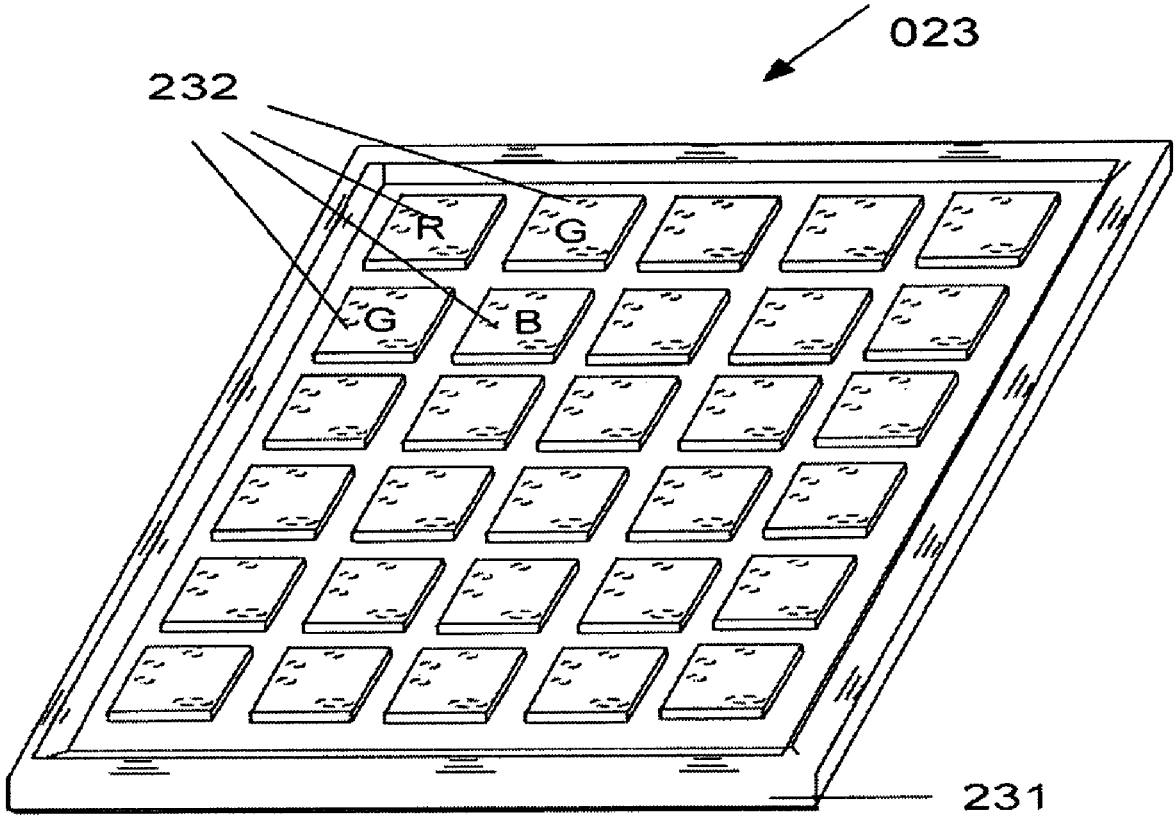
FIG. 23 is the isometric view of the assembly of discrete pixels, fabricated according to the present invention, on a frame body to form a large area plasma display.

FIG. 23 shows a rigid plastic frame assembly 023 that contains a recessed frame 231 and the plurality of basic pixel panel assembly illustrated in FIG. 22. The basic pixel panel assembly 232 is assembled in the recessed frame 231 in R-G-G-B (Red-Green-Green-Blue) format for building a large area color display of several feet in diagonal.

Figure 24:
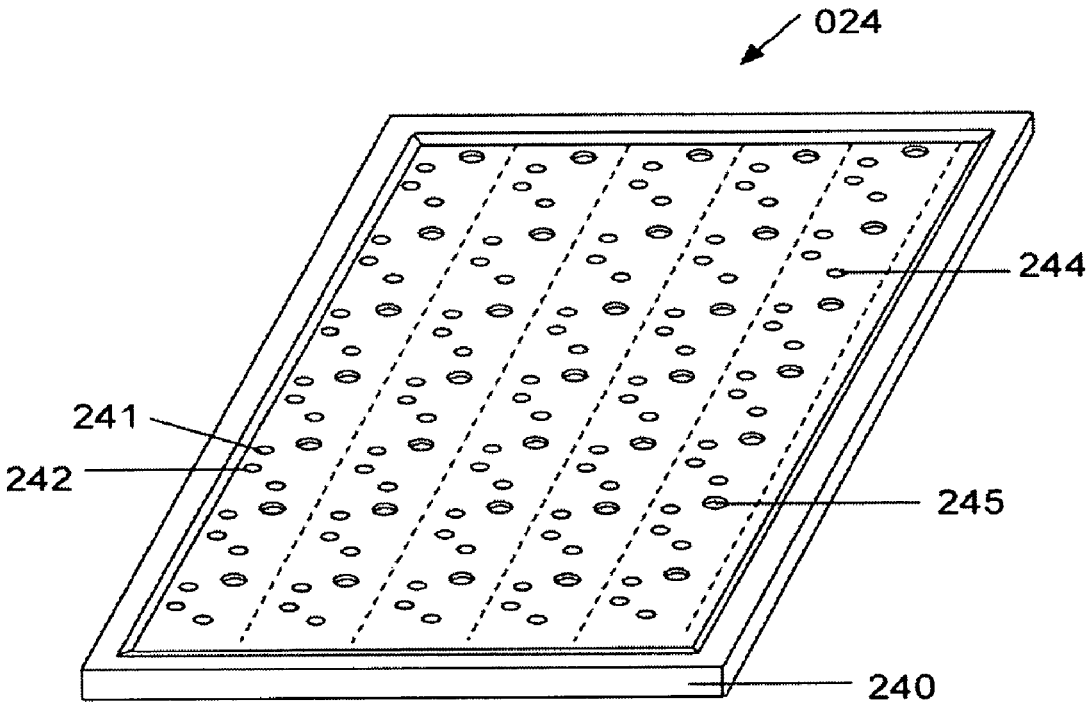
FIG. 24 is the isometric view of an assembly frame showing the relief holes for connecting leads on the discrete pixel assembly.

FIG. 24 shows a recessed rigid plastic back frame 024 that contains holes 241 and 242 for the insertion of sustain electrode pins and 244 for the insertion of address electrode pins. The exhaust tube's tip-off protection cover is relieved by the holes 245. The front frame shown in FIG. 23 is assembled in to this back frame 240 and clamped firmly.

Figure 25:
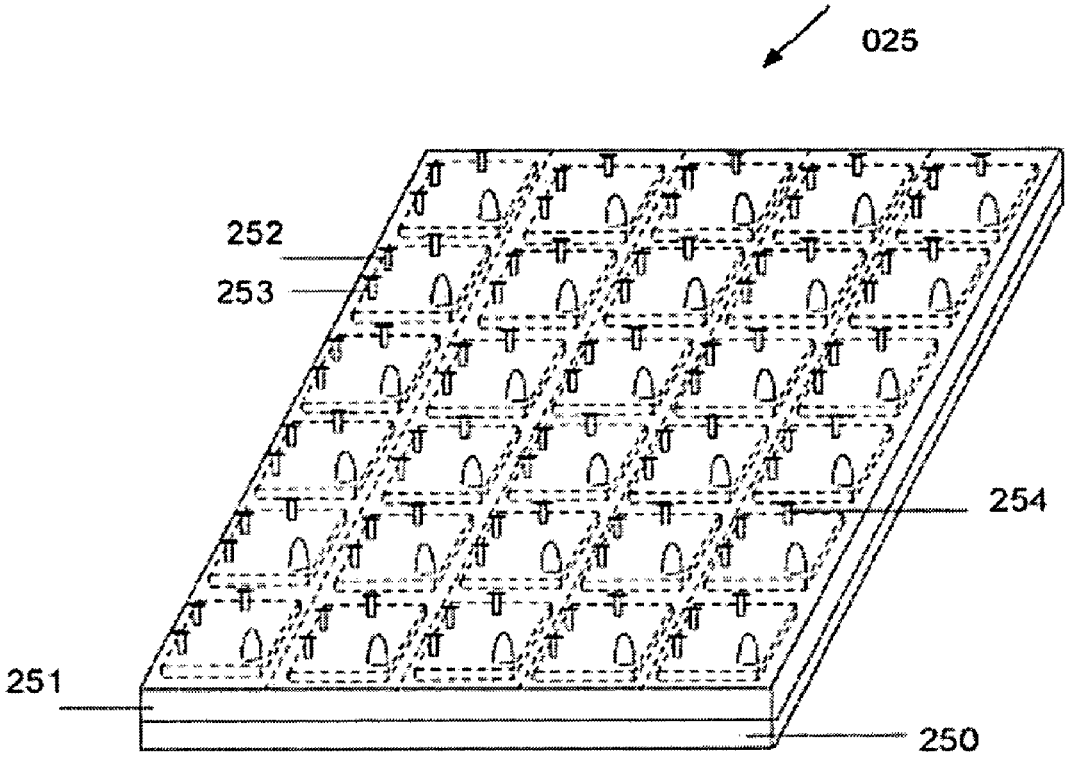
FIG. 25 is the isometric view of the assembly of two frames depicted in FIG. 23 and FIG. 24 with top electrical connections of discrete pixel assembly.

FIG. 25 shows the back view of the assembly 025 after the frame 250, containing the basic pixel panels, is assembled in frame 251 comprising the corresponding holes to relieve the sustained electrode pins 252, 253 and address electrode pins 254. In FIG. 25, the pixels are facing down. Appropriately dimensioned mechanical slots for alignment, adjustment and rigid assembly are not shown in FIG. 25.

Figure 26:
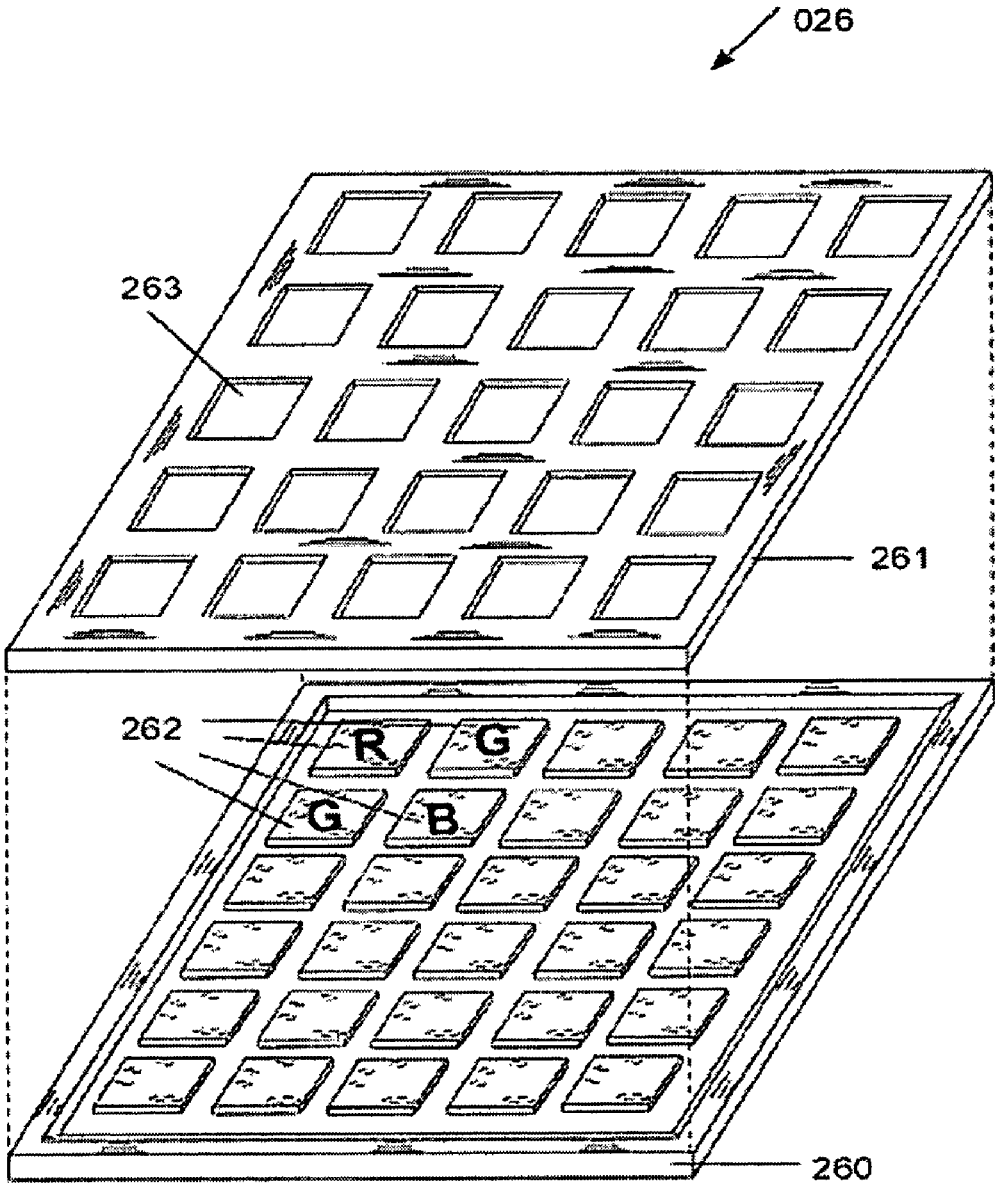
FIG. 26 is the exploded view of the final assembly of the sub-assembly as depicted in FIG. 25 with a protective cover assembly.

FIG. 26 illustrates the final assembly 026 of the subassembly shown in FIG. 25. The subassembly unit 260, containing the basic pixel panels in R-G-G-B format 262, is assembled in a front frame 261, containing windows to accommodate the basic pixel panels 262. Mechanical enclosures for operation under extreme temperature environment are not shown in FIG. 26.

Figure 27:
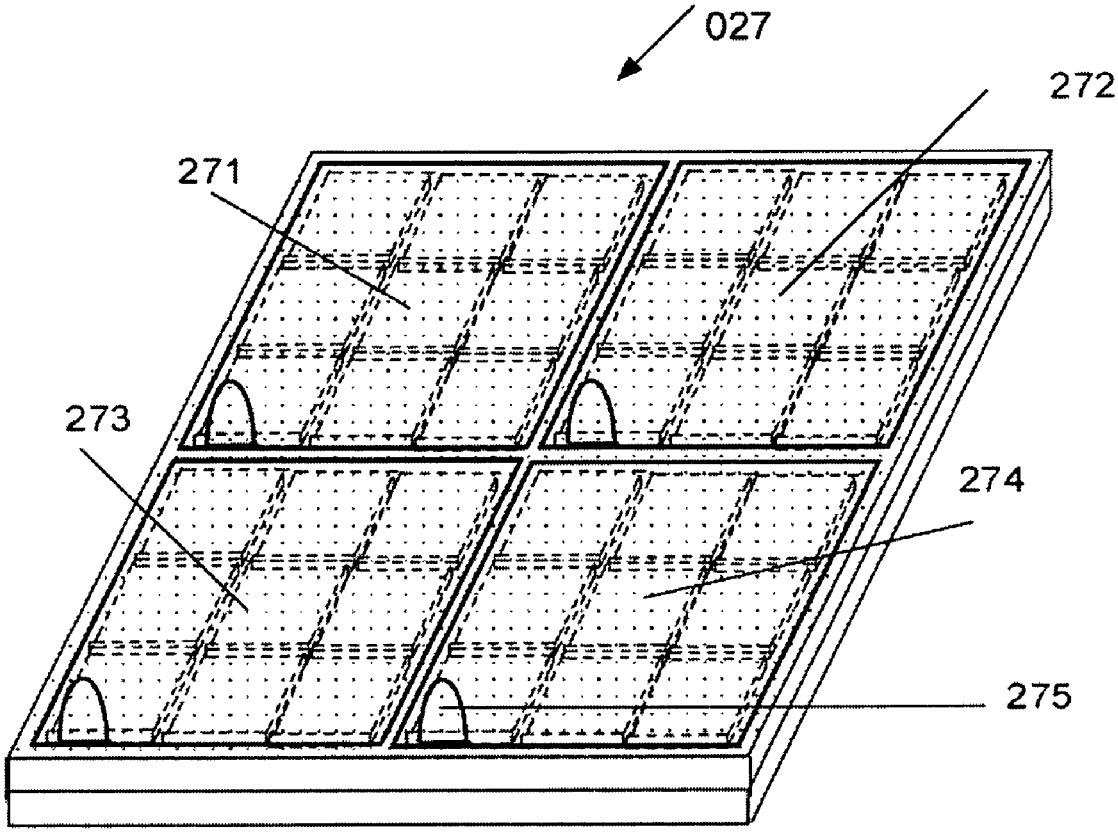
FIG. 27 is the isometric upside-down view of assembly of plurality of 'tiles' containing plurality of pixels processed in each 'tile', according to the present invention, with top tip-off tabulation.

FIG. 27 presents the assembly 027 of plurality of 'tiles' 271, 272, 273 and 274 comprising plurality of basic pixel panels with the common exhaust hole tube protection cover 275 protruding at the back side of 'tiles'. This illustration is for 2×2 matrix of 'tiles'. Multiple of these matrices need to be assembled to derive a large area display.

It will be understood that one skilled in the art could modify the above basic design dimensions, geometries, sequence of assemblies. Various modification and variations can be made in the construction, configuration and/or operation of the present invention without departing from the scope or spirit of the invention. By way of example, the dielectric barrier described in the present invention can be modified in geometry from cylindrical to oval or semi-circular or any combination and plurality of these shapes and sizes. The profile of 'corrugated bump' in the substrate to make the dielectric barrier integral to the substrate can be changed and number of 'bumps' can be changed. Further, the hollow electrode described in the present invention has one electrode on each side. This can be split in to several on each side operating in parallel. Another example is the change in spacing between the front substrate and back substrate of the basic pixel panel that can influence the path of plasma and hence the efficiency of the display. Still another example is extending the phosphor coating area to the inside surface of the side wall of frit seal. Thus it is intended that the present invention covers the modifications and variations of the invention provided they come within the scope of the appended claims and their equivalents.

I claim:

1. A large area plasma display comprising: a plurality of sealed plasma pixel panels each having two opposing substrates of which one substrate contains an address electrode, coated with a thin dielectric layer followed by a reflective dielectric layer and further followed by a phosphor layer, the other substrate contains two coplanar plasma sustain electrodes with a dielectric barrier between the plasma sustain electrodes, the plasma sustain electrodes and the dielectric barrier being coated with a thin dielectric layer followed by an electron secondary emission layer;

said address electrode and plasma sustain electrodes being located on said substrates so as to be orthogonal to each other in opposition to create a plasma pixel;

said opposing substrates being hermetically sealed with a frit glass to create a space between the said substrates;

said space between the said substrates being filled with an inert gas and mercury;

said sustain electrodes, dielectric barrier and address electrodes, in combination with a suitable voltage, generating an increased path length of plasma that generates increased ultra-violet rays which excites the phosphor resulting in enhanced visible light output from plasma pixels;

said plasma pixel assembly incorporating integrated lead-in from interior of pixels to exterior pins for address electrodes and sustain electrodes;

said plasma pixel assembly further assembled in large rigid plastic frames in plurality in a desired color format to form a large area plasma display;

means for externally connecting and applying electrical signal to the said large area plasma display comprising plurality of said plasma pixels, to generate information on the said large area plasma display, through selective visible light emission from the said plasma pixels;

said large area plasma display comprising tiles of plasma pixels containing coplanar sustain electrodes and address electrodes;

said coplanar sustain electrodes intervened by dielectric barriers said coplanar sustain electrodes have a length in the range of 6 mm to 300 mm and a linear distance between them in the range of 6 mm to 300 mm, excluding the curved length of dielectric barrier between them.

2. The large area plasma display as claimed in claim 1 wherein the coplanar sustain electrodes are plurality of pairs of split sustain electrodes opposing each other in coplanar configuration.

3. The large area plasma display as claimed in claim 1 wherein the coplanar sustain electrodes are rectangular or oval or circular hollow electrode positioned at an angle, with respect to the substrate plane, in the range of zero degree to 45 degree.

4. The large area plasma display as claimed in claim 3 wherein the coplanar sustain electrodes are plurality of pairs of sustaining electrodes opposing each other in coplanar configuration.

5. The large area plasma display as claimed in claim 3 wherein the internal surface of the coplanar sustain hollow electrodes are coated with electron emissive coatings of Barium oxide, or cerium oxide or lithium fluoride or mixtures of Ba, Sr and Ca oxides in the ratio of 50:40:10.

6. A large area plasma display comprising: a plurality of sealed plasma pixel panels each having two opposing substrates of which one substrate contains an address electrode, coated with a thin dielectric layer followed by a reflective dielectric layer and further followed by a phosphor layer, the other substrate contains two coplanar plasma sustain electrodes with a dielectric barrier between the plasma sustain electrodes, the plasma sustain electrodes and the dielectric barrier being coated with a thin dielectric layer followed by an electron secondary emission layer;

said address electrode and plasma sustain electrodes being located on said substrates so as to be orthogonal to each other in opposition to create a plasma pixel;

said opposing substrates being hermetically sealed with a frit glass to create a space between the said substrates;

said space between the said substrates being filled with an inert gas and mercury;

said sustain electrodes, dielectric barrier and address electrodes, in combination with a suitable voltage, generating an increased path length of plasma that generates increased ultra-violet rays which excites the phosphor resulting in enhanced visible light output from plasma pixels;

said plasma pixel assembly incorporating integrated lead-in from interior of pixels to exterior pins for address electrodes and sustain electrodes;

said plasma pixel assembly further assembled in large rigid plastic frames in plurality in a desired color format to form a large area plasma display;

means for externally connecting and applying electrical signal to the said large area plasma display comprising plurality of said plasma pixels, to generate information on the said large area plasma display, through selective visible light emission from the said plasma pixels;

said large area plasma display comprising tiles of plasma pixels containing coplanar sustain electrodes and address electrodes;

said coplanar sustain electrodes have a length in the range of 6 mm to 300 mm and a linear distance between them in the range of 6 mm to 300 mm, excluding the curved length of dielectric barrier between them, said plasma pixels have an area in the range of 9 mm times 9 mm to 350 mm times 350 mm.

* * * * *